US005209190A

United States Patent [19]

Paul

[11] Patent Number: 5,209,190

[45] Date of Patent: May 11, 1993

[54] ROTARY POWER DEVICE

[76] Inventor: Eddie Paul, 414 W. Walnut St., El Segundo, Calif. 90245

[21] Appl. No.: 723,760

[22] Filed: Jul. 1, 1991

[51] Int. Cl.[5] ..... F02B 57/00; F01B 13/04; F04B 27/08; F04B 35/00

[52] U.S. Cl. ..... 123/43 AA; 91/499; 417/271; 417/364

[58] Field of Search ..... 123/43 A, 43 AA, 58 AB; 91/499; 417/269, 364

[56] References Cited

U.S. PATENT DOCUMENTS

| | | | |
|---|---|---|---|
| 848,665 | 4/1907 | Lombard | 123/43 A |
| 1,229,009 | 6/1917 | Allison | 123/58 AB |
| 1,569,525 | 1/1926 | Owens | 123/43 AA |
| 1,614,476 | 1/1927 | Hutchinson | 123/43 AA |
| 2,949,100 | 8/1960 | Petersen | 123/43 AA |
| 3,687,117 | 8/1972 | Panariti | 123/43 A |
| 4,287,858 | 9/1981 | Anzalone | 123/43 AA |

*Primary Examiner*—Michael Koczo
*Attorney, Agent, or Firm*—John E. Vanderburgh

[57] ABSTRACT

A rotary power device comprises an open ended stationary housing defining an interior having a sinusoidal cam track disposed therein and end walls closing each open end of the housing. At least one fluid inlet port and one fluid outlet port is provided in the end walls for fluid communication between the housing interior and the exterior of the end wall. A rotor assembly is disposed in the interior of the housing for rotation about the axis of the housing. The rotor assembly includes a central shaft extending axially through the interior of the housing which is rotatably carried by each of the end walls. At least one heat conducting disk is mounted on the shaft adjacent each of the end walls for rotation with the shaft. Each disk has at least two openings equiangularly located with respect to one another and aligned with corresponding equiangularly disposed openings in the other disk for mounting open ended tubular cylinder elements which extend between the disks parallel to the axis of the shaft. The open ends of each cylinder element is located adjacent a corresponding end wall for intermittant communication with the ports as the rotor assembly rotates. An elongated piston including a piston head is slidingly disposed in each cylinder element for reciprocal movement parallel to the axis of the shaft. Each piston includes a normally extending follower which extends through an elongated closed ended opening in the cylinder element into the sinusoidal track in the housing. A manifold communicates with the outlet port for collecting and conducting fluid expelled from the outlet port. The pistons reciprocate in their respective cylinder elements responsive to the follower in the sinusoidal track as the rotor assembly rotates. The rotary power device serves as an engine or compressor or combination of the two and is easily modified from one form to another simply by changing end walls.

14 Claims, 4 Drawing Sheets

FIG. 1
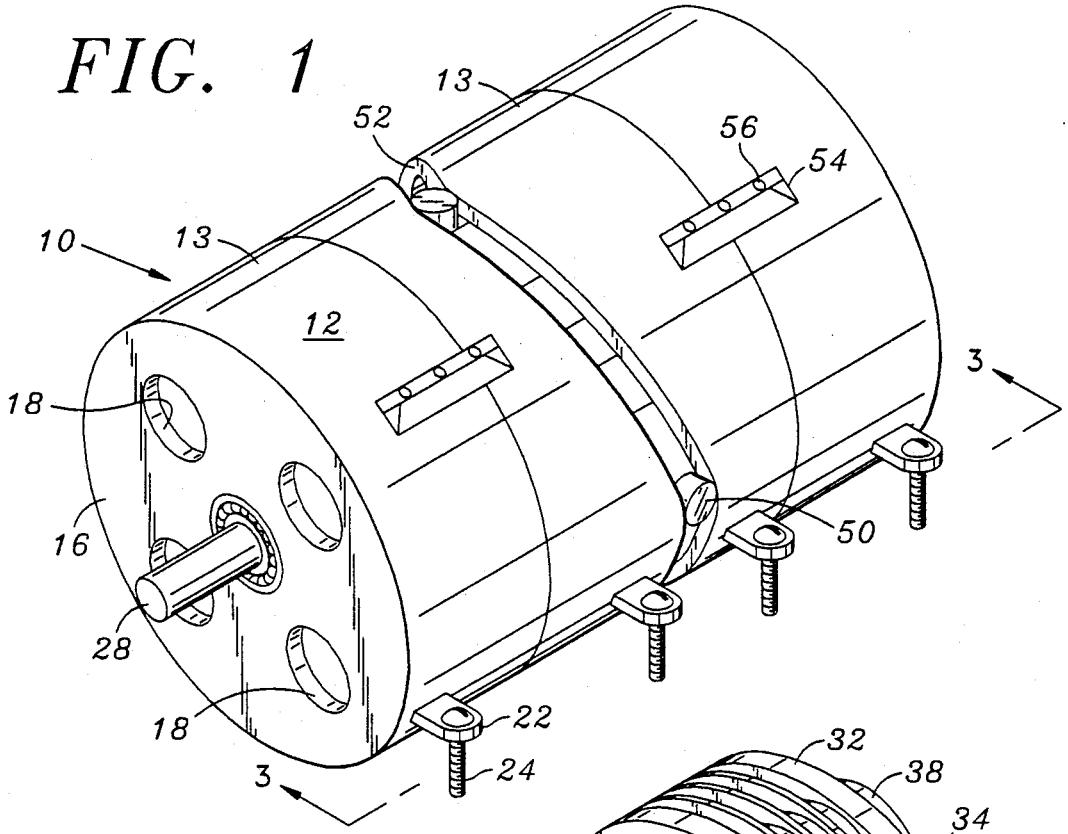
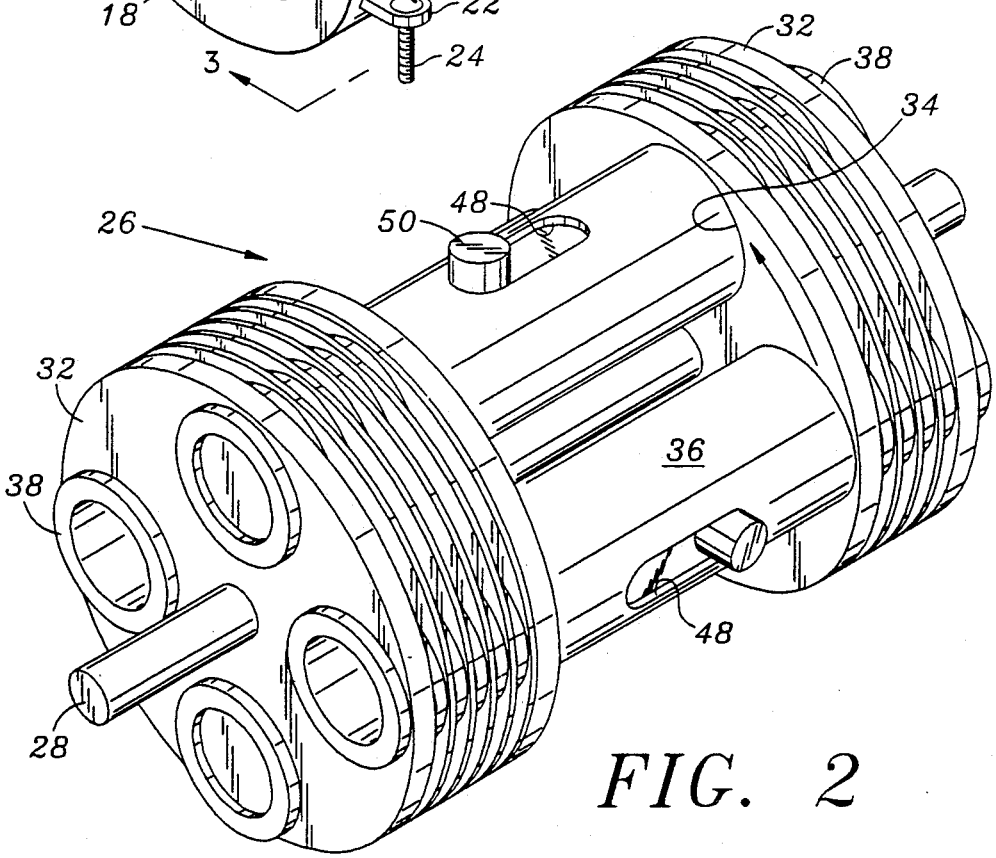
FIG. 2

ROTARY POWER DEVICE

FIELD OF INVENTION

This invention relates to rotary power devices and more particularly to rotary internal combustion engines, pumps and compressors.

SUMMARY OF THE INVENTION

It is an object of the present invention to provide a rotary power device both as an internal combustion engine and for compressing and pumping fluids.

Another object of the invention is to provide an improved rotary air compressor which maximizes output as compared to conventional pumps and compressors.

Another object of the invention is to provide in a single unit an engine and a compressor.

Another object of the invention a rotary power device which is readily convertible between an internal combustion engine and a compressor.

Another object of the invention is to provide a rotary power device having relatively few parts.

Still another object of the invention is to provide a rotary power device having valveless ports which are substantially equal in diameter to the diameter of the pistons of the rotary device so as to reduce resistance to fluid inflow and outflow.

Yet another object of the invention is to provide an improved means for air cooling the rotary power device.

These and other objects and advantages of the present invention will be apparent from the following detailed description and from the recital of the appended claims, particularly when read in conjunction with the accompanying drawings.

BRIEF DESCRIPTION OF THE DRAWINGS

FIG. 1 is a perspective view of a rotary compressor designed in accordance with the present invention and having a portion of the outer housing cut away for purposes of illustration;

FIG. 2 is a perspective view of the rotor assembly of the compressor of FIG. 1;

DETAILED DESCRIPTION OF THE INVENTION

Figure 3:
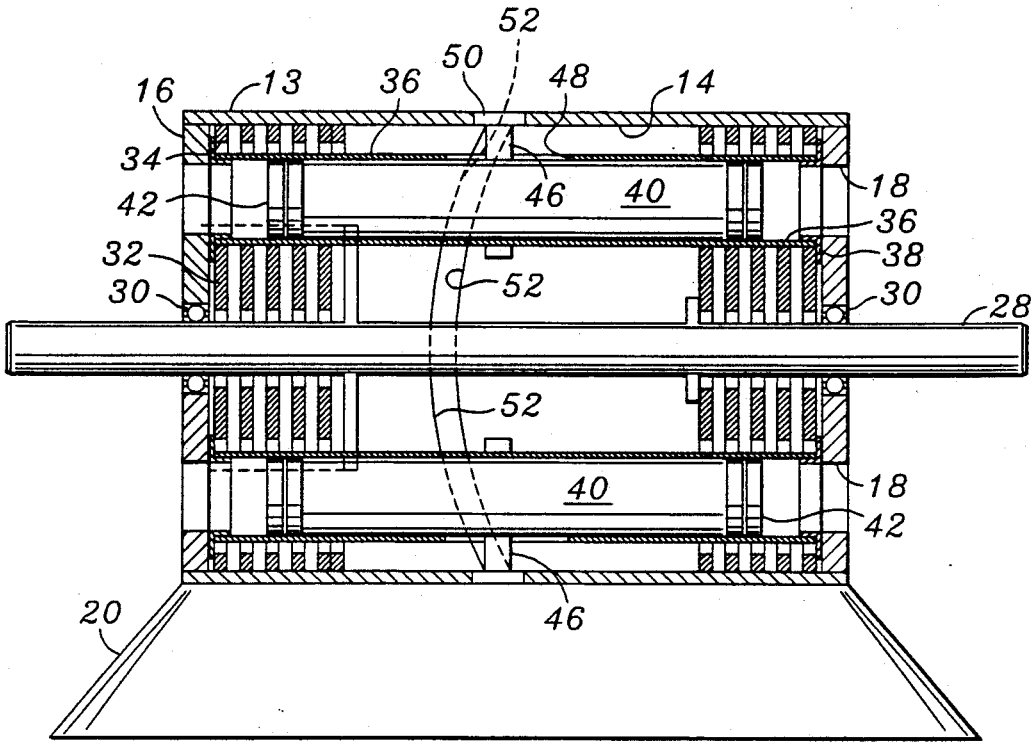
FIG. 3 is a side sectional view taken along line 3—3 of FIG. 1.
Figure 5:
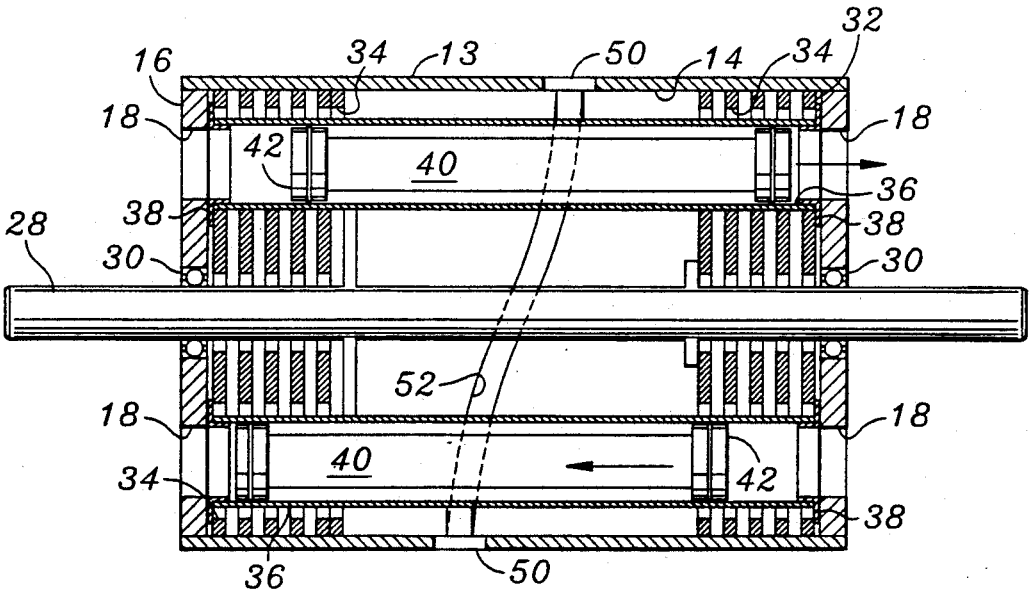
FIG. 5 is a top sectional view of the compressor of FIG. 1.

In the accompanying FIGS. 1-5, for the purposes of illustrating the principals of this invention, there is disclosed an air compressor. It will be understood, however, that various features of this invention, particularly the input and output of the reciprocating pistons and the translation of reciprocating motion to rotary motion and vice versa, have utility and may be successfully employed with other devices than air compressors, as for example, with pumps, steam engines, internal combustion engines, and the like.

Referring to FIGS. 1-5, the compressor of the present invention, shown generally as 10, includes a stator 12 consisting of a cylindrical housing 13 having a bore 14 which defines an interior for the housing 13 which is closed by end walls 16. In the present embodiment the end walls 16 are each provided with four ports 18 which are equiangularly and annularly disposed about the end walls 16. In the four port configuration each port is annularly disposed at 90 degrees with respect to adjacent ports 18. The lower portion of the cylindrical housing 13 is adapted to be secured to a base member 20, such as by the provision of ears 22 through which extend bolts 24 for securing the housing 13 in corresponding threaded passages (not shown) in the base member 20. The end walls 16 are likewise secured to the cylindrical housing 13 by means of bolts (not shown).

A rotor assembly, shown generally as 26, comprises a central shaft 28 which extends axially through the bore 14 of the cylindrical housing 13 and the shaft is rotatably carried by a bearing assembly 30 centered in each of the end walls 16. Cooling disks 32 are secured to the shaft 28 for rotation therewith and are disposed on the shaft 28 in two groups, each consisting of six disks 32. The disks 32 of each group are likewise spaced apart to provide for air flow therebetween. The disks 32 are each provided with four openings 34 which are spaced apart 90 degrees and radially located from the center of the disk 32 for intermittent alignment with the ports 18 of the end walls 16 as the disks and shaft rotate. The openings 34 are aligned parallel to the axis of the shaft 28 to receive and secure the end portions of a cylinder element 36. As illustrated, there are four cylinder elements 36 which are disposed parallel to each other and to the axis of rotation of the shaft. Each of the cylinder elements 36 is open-ended and is provided at its opposite ends with a suitable packing collar 38 having sliding engagement with the inner face of the end walls 16 of the stator 12 to establish fluid tight engagement therewith. Suitable packing materials are well known in the art and do not per se form in part of this invention. Slidingly disposed in each of the cylinder elements 36 is a reciprocating piston 40 having a piston head 42 on each end and one or more piston rings 44 for fluid tight slidable sealing with the inner wall surfaces of the cylinder element 36. Each piston 40 is provided with a piston pin 46 which is disposed medially and diametrically of each of the pistons and which projects through an axially extending slot 48 provided in the side wall of each cylinder element 36. The extending end of the piston pin 46 is provided with a cam follower 50 which is configured to be received in a sinusoidal cam track 52 formed on the inner wall of the cylindrical housing 13 of the stator 12. To reduce friction, the cam follower 50 may be journaled for rotation about the piston pin 46 so as to serve as a roller in the cam track 52. The design and configuration of the cam follower 50 in the cam track 52 is well known in rotary engine and pump construction and does not per se form a part of this invention.

In operation, power is applied to the shaft 28 by means such as an electric motor to cause rotation of the rotor assembly 26 within the stator 12. Rotation of the rotor assembly 26 causes the pistons 40 to reciprocate in their respective cylinder elements 36 through the action of the cam follower 50 against the edges of the cam track 52 as the rotor assembly 26 rotates with respect to the stator 12. Each piston head 42 operates on a two-stroke cycle to draw air into the cylinder element 36 and to compress the air during the compression stroke. During the intake stroke, pressure is reduced in an area defined by the piston head 42, the sidewalls of the cylinder element 36 and the end wall 16. As the cylinder element 36 moves around the end walls 16 and comes into alignment with a port 18, air is drawn into the defined area and the compression stroke begins as the cylinder element 36 moves out of alignment with the port 18 and the piston head 42 begins moving toward the end wall to reduce the volume of the defined space and to initiate compression of the air therein. At the completion of the compression stroke the piston 40 reaches top dead center and maximum compression at the piston head 42 is reached. As the cylinder element 36 moves into alignment with the next port 18 and the compressed air exits the cylinder element 36 through the port 18 into a manifold and line, not shown, which leads the compressed air to a receiving tank or a user device (not shown). It will be understood that as one head 42 of the piston 40 is in the compression cycle the piston head 42 on the opposite end is in the intake stroke. In effect each piston 40 thus operates as two pistons. In the embodiment shown, each piston head 42 completes two intake and compression cycles during one complete 360 degree revolution of the rotor assembly. One revolution of the rotor assembly 26 thus provides the effect of 16 pistons.

The compression of air in the cylinder element 36 and the reciprocal movement of the pistons in the cylinder elements generates heat within the pump. The spaced apart disks 32 carried by the shaft 28 operate to conduct heat generated in the cylinder elements and to radiate the heat into the interior of the cylindrical housing. Accordingly, the disks 32 are preferably formed of a heat conductive material such as aluminum. The cylindrical housing 13 is provided with recesses 54 in which are located ventilating apertures 56 for the circulation of air from the exterior to the interior of the housing 13 and visa versa. Moreover, in the embodiment illustrated, the cylindrical housing 13 is formed in two halves, the inner ends of which have a complimentary wave form. When the halves are assembled on the base, the complimentary ends are spaced apart to define the sinusoidal cam track. This also provides for communication between the exterior of the housing 13 and its exterior to allow for the circulation of outside air into the interior of the housing. If desired, fan blades, not shown, may also be affixed to the shaft 28 for circulation of air within the housing 13 while the shaft 28 is rotating.

The rotor assembly 26 is balanced to reduce vibration and undue wear of the shaft 28 and bearing assemblies 30. In addition, the rotation of the rotor housing 13 and the horizontal reciprocation of the pistons permits the rotor assembly 26 to operate as its own fly wheel and no external or additional fly wheel is required.

The compressor of the present invention is extremely efficient in that it has a minimum of moving parts and the movement of air into and out of the cylinder elements is largely unrestricted because of the large diameter of the ports, which are essentially the same diameter as the piston head.

The efficiency of the compressor of the present invention is illustrated in the following example in which a compressor constructed as illustrated in the embodiment of FIG. 1 is provided with four cylinder elements each having a one inch bore 14 and slidably receiving a piston 40 having a one inch stroke to provide a compression ratio of 10 to 1. The overall dimension of the complete compressor assembly illustrated by this example is 6×12 inches.

As described the compressor goes through two complete cycles in one revolution so that the effectively the compressor is a 16 cylinder compressor. Each piston head 42 on the intake stroke takes in approximately 0.71 cubic inches. Assuming 1,000 revolutions per minute, the compressor will compress approximately 11,312 cubic inches or 6.54 cubic feet per minute with a pressure of 150 pounds per square inch. Increasing the revolutions of the rotor assembly 26 to 2250 rpm will increase the output of the compressor to 14.72 cubic feet per minute. The compressor has been tested to a maximum rpm of 40,000 rpm. Thus it will be seen that by increasing the rpm of the rotor assembly 26 to a modest 10,000 rpm, the pump will be capable of out putting 65.4 cubic feet per minute of pressurized air.

It will be understood that in the example set forth above, that the stroke and compression ratio can be increased by lengthening the slot 48 of the cylinder element 36 so that the output of air is at a higher pressure than 150 pounds. The dimensions of the bore 14 of the cylinder and the circumference of the pistons can be increased to increase the output of compressed air. Likewise, the size of the compressor can be increased and the number of cylinder elements and pistons may be increased, for example from 4 to 8 cylinder elements. However, the pump can operate effectively with as few as two cylinder elements.

The apparatus described herein produces a highly efficient compressor and/or pump for compressing or moving fluids. It operates with a minimum of moving parts which can be manufactured at relatively low cost and readily maintained. However, the power device of the present invention is readily converted to an internal combustion engine by merely changing one or both end walls 16 of the device.

Figure 7:
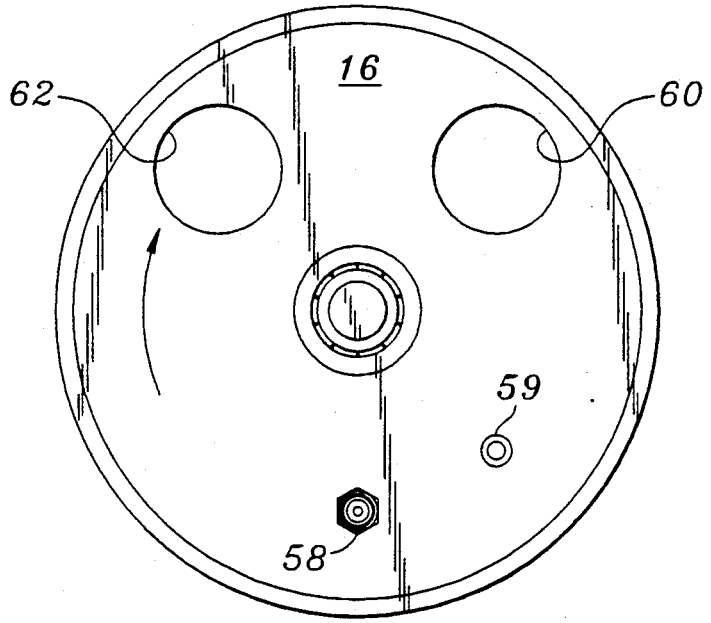
FIG. 7 is an end view of the engine side of the device of FIG. 6.
Figure 4:
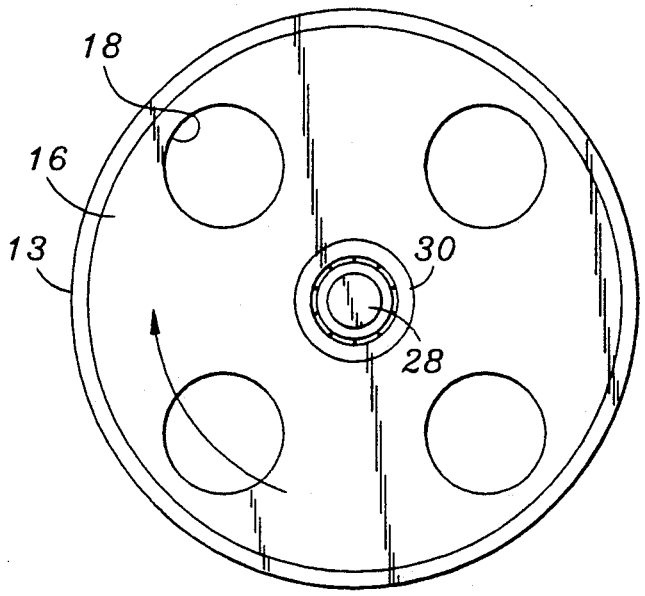
FIG. 4 is an end view of the compressor of FIG. 1.
Figure 6:
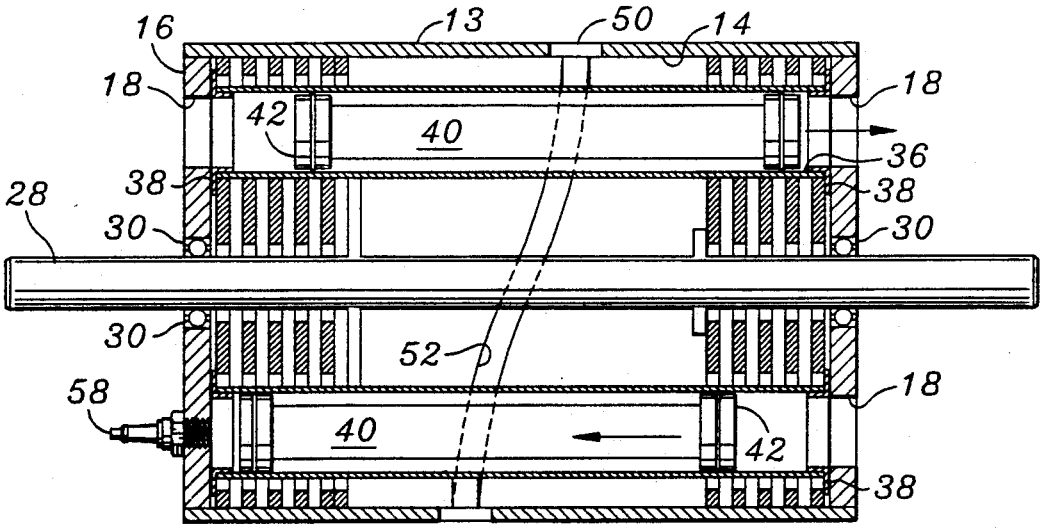
FIG. 6 is a side sectional view of a rotary internal combustion engine and compressor designed in accordance with the present invention.

Referring to FIGS. 6 and 7 where like reference numbers designate like parts, there is illustrated a rotary power device comprising a combination internal combustion engine and compressor which is formed by modifying an end wall 16' to include an air/fuel injection nozzle 59 and a glow plug 58. The port 60 is an intake port which communicates with an intake manifold and carburetor (not shown) for delivery of an air/fuel to the cylinder element 36. In the embodiment illustrated, the rotary engine includes four reciprocating pistons 40, each of which operate in a four stroke cycle during each revolution of the rotor assembly 26. Nozzle 59 communicates through the intake port 60 to inject the air/fuel mixture into the interior of each cylinder element 36 as it rotates into alignment with the intake port 60 as the piston therein is moving away from the end wall 16' during the intake stroke. The glow plug 58, connected to a suitable source of electrical power (not shown) such as an automotive battery, is located in the end wall 16' at top dead center of the compression stroke of the piston and operates in a known manner to ignite the compressed air/fuel mixture in the cylinders as they rotate into alignment therewith. A port 62 is in communication with an exhaust manifold (not shown). In operation, a starter motor (not shown) is connected to the shaft 28 in a manner conventional for internal combustion engines to initiate rotation of the rotor assembly 26 to start the engine. The pistons 40 reciprocate in their respective cylinder elements 36 through the action of the cam follower 50 in the cam track 52 as described in connection with the compressor embodiment of the invention illustrated in FIGS. 1-5. Each of the pistons 40 operate on a four stroke cycle drawing in an air/fuel mixture from the nozzle 59 through the port 60. Taking one of the pistons 40 as an example, as the rotor assembly 26 rotates the piston 40 moves toward the end wall 16' compressing the air/fuel mixture. At or near top dead center of the compression stroke, the cylinder element 36 containing the compressed air/fuel mixture rotates into alignment with the glow plug 58 which ignites the mixture to drive the piston 40 in its power stroke away from the end wall 16' and by means of the cam follower in the cam track 52 the movement of the piston 40 is translated into rotation of the rotor assembly 26. The cycle is repeated for each of the pistons 40 as the rotor assembly 26 rotates.

In the embodiment illustrated, it will be understood that the side of the device opposite the end wall 16' functions as a compressor in the manner described in connection with FIGS. 1-5. Thus there is provided in single unit a self propelled compressor. However, both of the end walls 16 of a compressor designed in accordance with the invention may be exchanged for the end wall 16' to completely convert the device from a compressor to an eight cylinder internal combustion engine. In this case the end walls 16' are inverted with respect to one another so that opposite ends of each piston 40 are in opposite cycles. Similarly, the engine of the invention is readily converted to a compressor by exchanging the end walls 16' for the end walls 16.

As will be understood by those skilled in the art, various arrangements other than those described in detail in the specification will occur to those persons skilled in the art, which arrangements lie within the spirit and scope of the invention. It is, therefore, to be understood that the invention is to be limited only by the claims appended hereto.

Having described the invention, I claim:

1. A rotary power device comprising:

a. an open ended stationary housing defining an interior;

b. a sinusoidal cam track disposed in said interior of said stationary housing;

c. an end wall closing each said open end of said housing;

d. at least one fluid inlet port and one fluid outlet port in one of said end walls for fluid communication between said housing interior and the exterior of said end wall;

e. a rotor assembly disposed in said interior of said housing, said rotor assembly including a central shaft extending axially through said interior of said housing, said shaft being rotatably carried by each of said end walls, at least one heat conducting disk mounted on said shaft adjacent each of said end walls for rotation with said shaft, each said disks having at least two openings equiangularly located with respect to one another and aligned with corresponding equiangularly disposed openings in said other disk, said openings radially located from the center of said disks for intermittent alignment with said ports of said end walls as said rotor assembly rotates, said aligned openings carrying end portions of open ended tubular cylinder elements which extend between said disks parallel to the axis of said shaft, said open ends of each said cylinder element being located immediately adjacent to a corresponding end wall for intermittent communication with said ports as said rotor assembly rotates, an elongated piston including a piston head slidingly disposed in each said cylinder element for reciprocal movement parallel to the axis of said shaft, said piston including a normally projecting follower which extends through an axial slot in said cylinder element and the extending end thereof being received in said sinusoidal track in said housing;

f. means for collecting and conducting fluid from said outlet port and means for conducting fluid to said inlet port;

whereby said pistons reciprocate in their respective cylinder elements in an intake and an exhaust cycle responsive to the rotation of said rotor assembly through the action of said follower in said sinusoidal track to drawn in, compress and output a fluid.

2. The rotary power device of claim 1 wherein both said end walls include at least an inlet port and an outlet port, said inlet port and said outlet port of one said end wall being disposed with respect to the axis of said shaft so as to be axially out of alignment with said inlet port and said outlet port of said other end wall whereby direct communication between the exterior of one end wall through said interior of said housing to the exterior of said other end wall is prevented.

3. The rotary power device of claim 1 wherein each of said end walls are provided with four ports which define a four port configuration in which each of said ports with respect to the axis of said shaft are equiangularly spaced from adjacent ports.

4. The rotary power device of claim 3 wherein each port of said four port configuration is disposed at a 90 degree angle with respect to the axis of said shaft from adjacent ports.

5. The rotary power device of claim 3 including four of said cylinder elements, the axis of each of said cylinder elements extending parallel to the other cylinder elements and parallel to the axis of said shaft, each said cylinder element being equiangularly disposed from adjacent cylinder elements on said rotor assembly about the axis of said shaft and being radially spaced from the axis of said shaft for intermittent alignment of the open ends thereof with said ports as said rotor assembly rotates.

6. The rotary power device of claim 1 further including a plurality of said heat conducting disks mounted in two groups on said shaft, a group being located adjacent each said end wall and said disks of each group being spaced apart to provide for air flow therebetween, said disks are each provided with four aligned openings which are spaced apart 90 degrees and radially located from the center of said disk for intermittent alignment with said ports of said end walls as the disks and shaft rotate.

7. The rotary power device of claim 1 wherein at least one of said end walls includes fuel injection means for the delivery of a fuel to said cylinder element adjacent said piston head and means for initiating ignition of an air fuel mixture within said cylinder element.

8. The rotary power device of claim 7 wherein said means for initiating ignition comprises a glow plug electrically connected to a source of electrical power.

9. The rotary power device of claim 2 wherein the opposite end portions of each of said elongated pistons define a piston head having sealing means about the circumference thereof for a fluid tight seal between the circumference of said piston head and the inner wall of said cylinder element while said piston is reciprocating, wherein each end of said piston undergoes an intake and an exhaust stroke cycle, the cycle at one end of said piston being opposite to the cycle at the opposite end thereof.

10. The rotary power device of claim 1 further including means for circulating a cooling fluid through said interior of said housing.

11. The rotary power device of claim 1 wherein said housing comprises two cylindrical elements having complimentary open inner ends opposite said end walls, said inner ends defining corresponding wave forms and spaced apart to form said sinusoidal track.

12. A rotary compressor comprising:

a. an open ended stationary housing defining an interior;

b. a sinusoidal cam track disposed in said interior of said stationary housing;

c. an end wall closing each said open end of said housing, each of said end walls provided with four ports which define a four port configuration in which each of said ports with respect to the axis of said shaft are equiangularly spaced from adjacent ports;

d. a rotor assembly disposed in said interior of said housing, said rotor assembly including a central shaft extending axially through said interior of said housing, said shaft being rotatably journalled by bearing means in each said end walls, at least one cooling disk mounted on said shaft adjacent each of said end walls, four open ended cylinder elements axially extending through said housing and carried by said disks, the axis of each of said cylinder elements extending parallel to the other cylinder elements and parallel to the axis of said shaft, each said cylinder element being equiangularly disposed from adjacent cylinder elements about the axis of said shaft and being radially spaced from the axis of said shaft for intermittent alignment of the open ends thereof with said ports as rotor assembly rotates, an elongated piston including a piston head at each end thereof slidingly disposed in each said cylinder element for reciprocal movement parallel to the axis of said shaft, said piston including a normally extending follower which extends from said piston through an axial slot in said cylinder element and the extending end thereof being received in said sinusoidal track;

e. means for collecting and conducting compressed fluid from said outlet ports to a use point; and f. means for providing rotational force to said shaft to cause said rotor assembly to rotate in said housing.

13. An internal combustion engine comprising:

a. an open ended stationary housing defining an interior;

b. a sinusoidal cam track disposed in said interior of said stationary housing;

c. an end wall closing each said open end of said housing, each of said end walls provided with an inlet and an outlet port and fuel injection means;

d. a rotor assembly disposed in said interior of said housing, said rotor assembly including a central shaft extending axially through said interior of said housing, said shaft being rotatably journalled by bearing means in each of said end walls, at least one cooling disk mounted on said shaft adjacent each of said end walls, four open ended cylinder elements axially extending through said housing and carried by said disks, the axis of each of said cylinder elements extending parallel to the other cylinder elements and parallel to the axis of said shaft, each said cylinder element being equiangularly disposed from adjacent cylinder elements about the axis of said shaft and being radially spaced from the axis of said shaft for intermittent alignment of the open ends thereof with said ports as said rotor assembly rotates, an elongated piston including a piston head at each end thereof slidingly disposed in each said cylinder element for reciprocal movement parallel to the axis of said shaft, each end of said piston operating in respective four stroke cycles, said piston including a normally extending follower which extends from said piston through an axial slot in said cylinder element and the extending end thereof being received in said sinusoidal track;

e. fuel injection means at said intake port for the delivery of a fuel to said open ends of said cylinder elements as they rotate into alignment therewith;

f. means for initiating ignition of said air fuel mixture after it is compressed within said cylinder element; and g. an exhaust manifold communicating with each of said outlet ports for receiving combustion products from said cylinder elements during the exhaust stroke of said piston.

14. A combination rotary internal combustion engine and compressor comprising:

a. an open ended stationary housing defining an interior;

b. a sinusoidal cam track disposed in said interior of said stationary housing;

c. a first end wall closing one open end of said housing to define the engine side of said device, said first end wall provided with an inlet and an outlet port, said first end wall further including a fuel injection nozzle in communication with said inlet port for the delivery of an air/fuel mixture to said inlet port and means for initiating ignition of said air fuel mixture after it has been compressed within said cylinder element;

d. a second end wall closing said other end of said housing to define the compressor side of said device, said second end wall having four ports which with respect to the axis of said shaft are equiangularly spaced from adjacent ports, two of said ports being fluid inlet ports and two of said ports being outlet ports for compressed fluid;

e. a rotor assembly disposed in said interior of said housing, said rotor assembly including a central shaft extending axially through said interior of said housing, said shaft being rotatably journalled by bearing means in each of said end walls, at least one cooling disk mounted on said shaft adjacent each of said end walls, four open ended cylinder elements axially extending through said housing and carried by said disks, the axis of each of said cylinder elements extending parallel to the other cylinder elements and parallel to the axis of said shaft, each said cylinder element being equiangularly disposed from adjacent cylinder elements about the axis of said shaft and being radially spaced from the axis of said shaft for intermittent alignment of the open ends thereof with said ports said end walls as said rotor assembly rotates, an elongated piston including a piston head at each end thereof slidingly disposed in each said cylinder element for reciprocal movement parallel to the axis of said shaft, said piston including a normally extending follower which extends from said piston through an axial slot in said cylinder element, the extending end of said follower being received in said sinusoidal track, said piston head of said pistons adjacent said first end wall reciprocating in said cylinder element in a four stroke engine cycle during each revolution of said rotor assembly, said piston heads of said pistons adjacent said second end wall reciprocating in two intake and compression cycles during each revolution of said rotor assembly; and f. an exhaust manifold communicating with each of said outlet ports for receiving combustion products from said cylinder elements during the exhaust stroke of said piston.

* * * * *